US006348014B1

(12) United States Patent
Chiu

(10) Patent No.: US 6,348,014 B1
(45) Date of Patent: Feb. 19, 2002

(54) GOLF PUTTER HEAD AND WEIGHT ADJUSTABLE ARRANGEMENT

(76) Inventor: Chih Hung Chiu, 10F, No. 201, Chung Shan Rd., Chung Li City, Taoyuan Hsien (TW)

( * ) Notice: Subject to any disclaimer, the term of this patent is extended or adjusted under 35 U.S.C. 154(b) by 0 days.

(21) Appl. No.: 09/639,320

(22) Filed: Aug. 15, 2000

(51) Int. Cl.[7] ..... A63B 53/06
(52) U.S. Cl. ..... 473/337; 473/340
(58) Field of Search ..... 473/131, 324, 473/334, 335, 336, 337, 338, 339, 340, 341, 288, 349, 350, 251, 256, 297, 291, 342, 345, 332, 312, 313

(56) References Cited

U.S. PATENT DOCUMENTS 2,163,091 A * 6/1939 Held
4,869,507 A * 9/1989 Sahm
4,962,932 A * 10/1990 Anderson
5,244,210 A * 9/1993 Au
5,344,151 A * 9/1994 Anderson
5,769,737 A * 6/1998 Holladay

* cited by examiner

*Primary Examiner*—Sebastiano Passaniti
(74) *Attorney, Agent, or Firm*—Pro-Techtor International Services

(57) ABSTRACT

A golf putter head and weight adjustable arrangement include a putter head body, the putter head body having a plurality of receiving holes respectively extended to a back side wall thereof in direction perpendicular to a face panel thereof, and a plurality of weights fitting the receiving holes and selectively fastened to the receiving holes to adjust the location of the center of gravity of the putter head body, the weights each having at least one annular locating groove around the periphery thereof, at least one rubber retaining ring respectively mounted on the at least one annular locating groove and adapted to secure the respective weight to the receiving holes of the putter head body, and a rear tool hole adapted to receive a hand tool being used to carry the weights in and out of the receiving holes of the putter head body.

5 Claims, 7 Drawing Sheets

GOLF PUTTER HEAD AND WEIGHT ADJUSTABLE ARRANGEMENT

BACKGROUND OF THE INVENTION

The present invention relates to golf putters, and more particularly to a golf putter head and weight adjustable arrangement, which enables the user to conveniently adjust the location of the center of gravity of the putter head.

Various golf putters have been disclosed, and have appeared on the market. In order to fit different application conditions, different putters may be used. However, it is inconvenient to carry a number of putters. In order to eliminate this problem, putters are made having a weight-adjustable putter head. U.S. Pat. No. 4,963,932, issued on Oct. 16, 1990 to Anderson; Thomas G, discloses a putter head having a horizontally extended screw hole for allowing the user to fasten weights of different sizes or weights to the two ends of the screw hole (see FIG. 1). U.S. Pat. No. 5,244,210, issued on Sep. 14, 1993 to Au, Lawrence discloses another structure of golf putter head, in which the putter head has a through hole, two metal or plastic plug members fixedly mounted in the through holes, weight elements respectively mounted on the plug members, and cover means covers the through hole. In the aforesaid two prior art designs, weights are selectively installed in the putter head from two opposite sides. These designs complicate the procedure of adjusting the weight of the putter head.

SUMMARY OF THE INVENTION

The invention has been accomplished under the circumstances in view. According to one aspect of the present invention, the golf putter head and weight adjustable arrangement include a putter head body, the putter head body having a plurality of receiving holes respectively extended to a back side wall thereof in direction perpendicular to a face panel thereof, and a plurality of weights fitting the receiving holes and selectively fastened to the receiving holes to adjust the location of the center of gravity of the putter head body. When the weights are selectively installed in the putter head body, the user can easily visually check the total weight added to the putter head. According to another aspect of the present invention, the weights can be made of different materials having different specific gravity, enabling the user to easily adjust the location of center of gravity of the putter head. According to still another aspect of the present invention, the weights each have having at least one annular locating groove around the periphery, and at least one rubber retaining ring respectively mounted on the at least one annular locating groove and adapted to secure the respective weight to the receiving holes of the putter head body. According to still another aspect of the present invention, the weights can be made having a rear tool hole adapted to receive a hand tool being used to carry the weights in and out of the receiving holes of the putter head body. According to still another aspect of the present invention, the weights can be made having a rear end attractive to a magnetic device, so that a magnetic device can be used to move the weights in and out of the receiving holes of the putter head body.

Reference Numerals in Drawings

Figure 1:
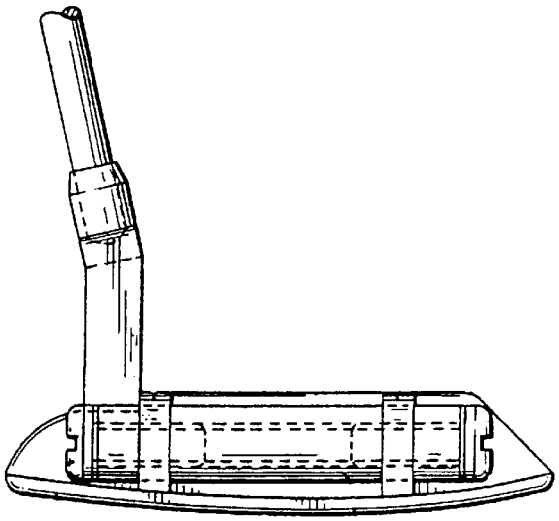
FIG. 1 PRIOR ART
FIG. 1 illustrates a golf putter head design according to U.S. Pat. No. 4,962,932.
Figure 2:
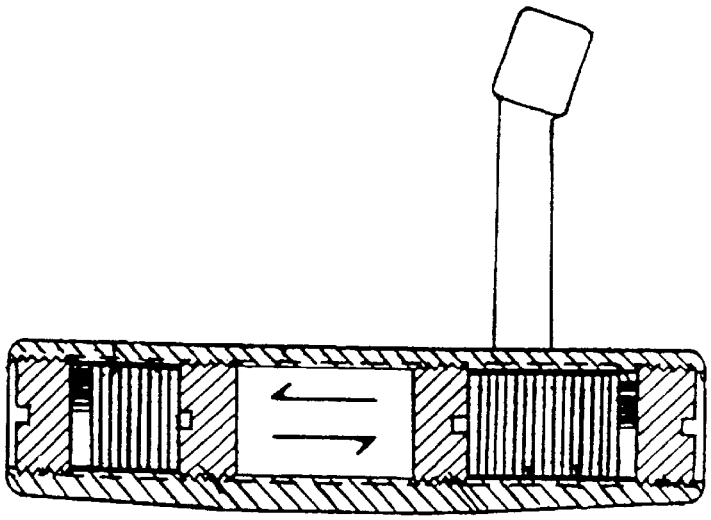
FIG. 2 PRIOR ART
FIG. 2 illustrates a golf putter head design according to U.S. Pat. No. 5,244,210.

| | |
|---|---|
| 1 putter head body | 12 face panel |
| 13 receiving holes | 2 weights |
| 21 peripheral wall | 211 annular grooves |
| 22 rubber retaining rings | 23 screw hole |
| 2a~2e weights | 21a~21e cylindrical middle parts |
| 3 screw rod | 4 magnetic device |

DETAILED DESCRIPTION OF THE PREFERRED EMBODIMENT

Referring to FIGS. from 3 through 6, the present invention comprises a putter head body 1, and a plurality of weights 2. The putter head body 1 comprises a face panel 12, and a plurality of receiving holes 13 extended to the back side wall thereof in a direction perpendicular to the face panel 12. The weights 2 are made of materials of different specific gravity (for example, aluminum alloy, magnesium alloy, zinc alloy, copper alloy, nickel alloy, lead alloy, tungsten alloy, and etc) and selectively fastened to the receiving holes 13 in the putter head body 1, having same dimension fitting the receiving holes 13, and a conical front end. Each weight 2 comprises a plurality of annular grooves 211 around the peripheral wall 21, and a plurality of rubber retaining rings 22 respectively fastened to the annular grooves 211. When mounting one weight 2 in one receiving hole 13, the conical front end of the weight 2 is aimed at the selected receiving hole 13, and then the weight 2 is forced into the receiving hole 13 by force. After insertion of the weight 2 into the selected receiving hole 13, the rubber retaining rings 22 are stopped against the peripheral wall of the receiving hole 13 to hold the weight 2 firmly in position. By means of selectively fastening the weights 2 in the receiving holes 13, the location of the center of gravity of the putter head body 1 is adjusted.

Figure 3:
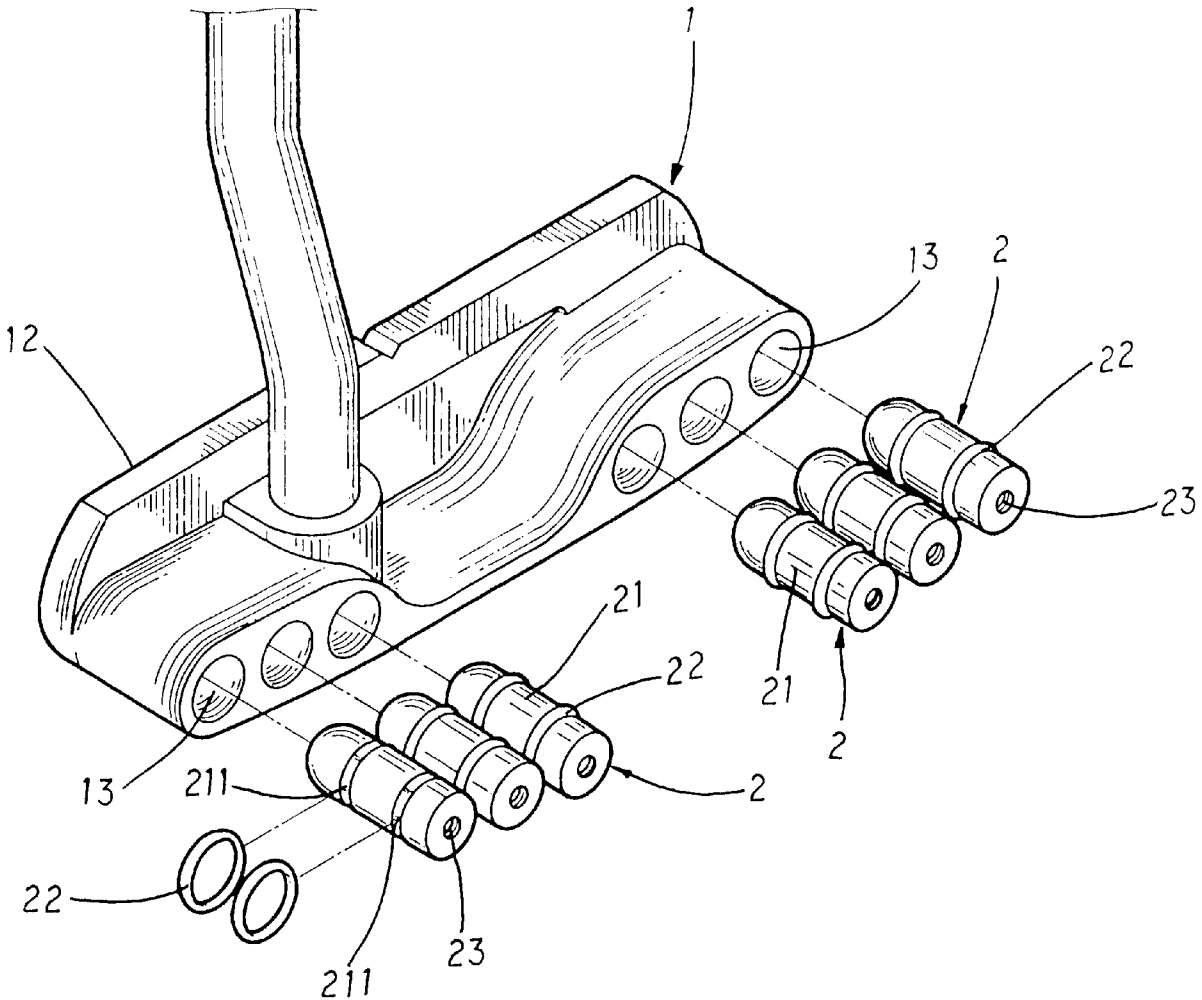
FIG. 3 is an exploded view of the present invention.
Figure 4:
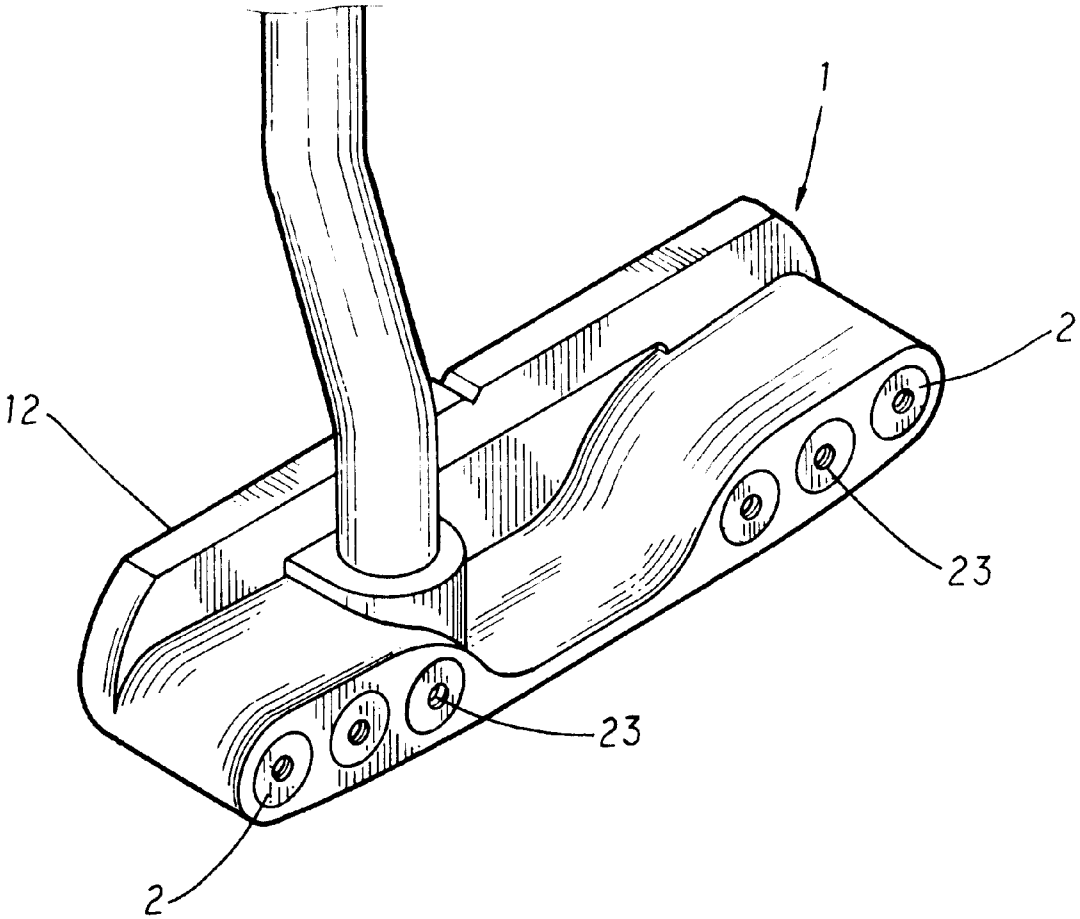
FIG. 4 shows an installation example of the weights in the putter head body according to the present invention.
Figure 5:
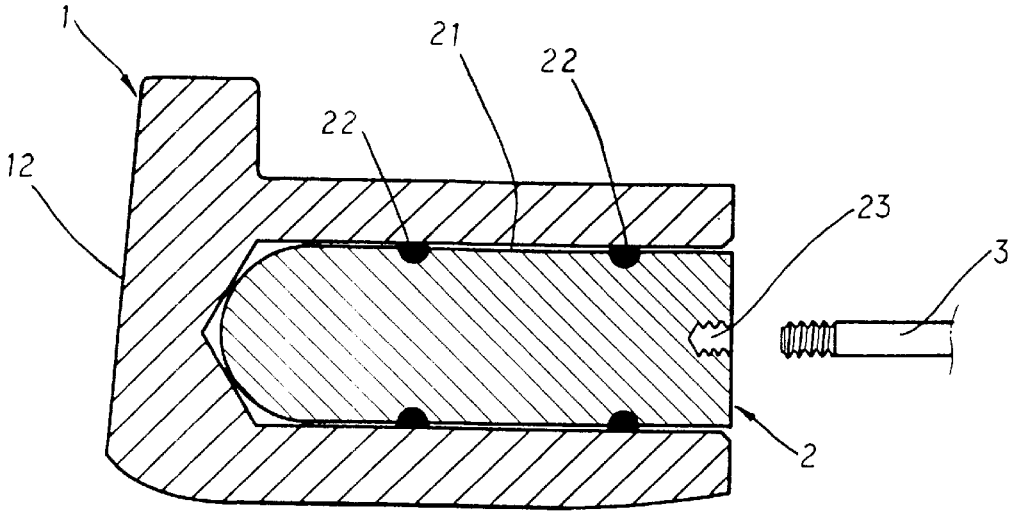
FIG. 5 is a sectional view showing a weight installed in one receiving hole of the putter head body.
Figure 6:
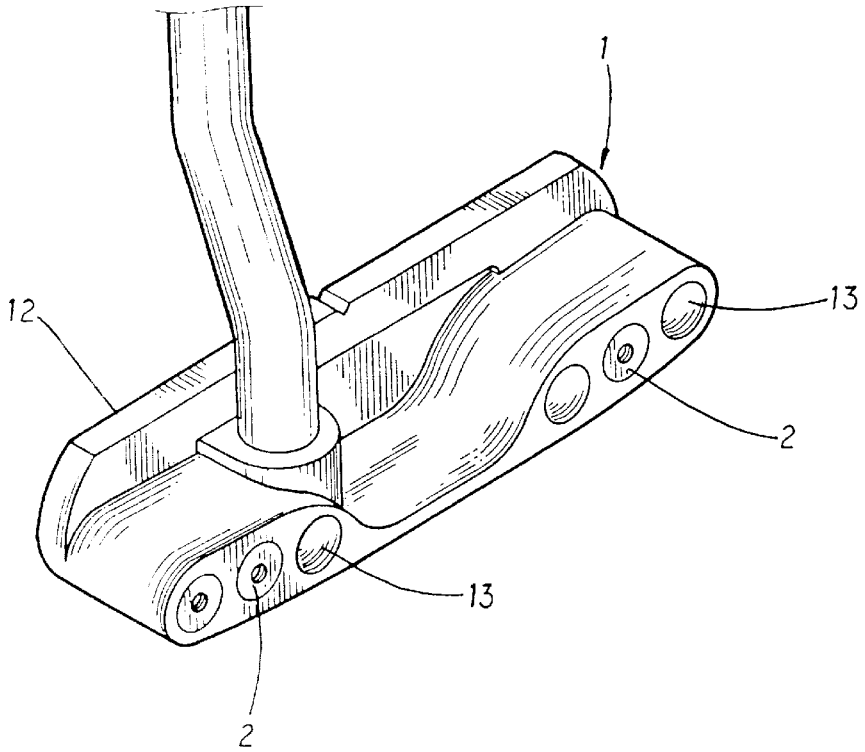
FIG. 6 shows another installation example of the weights in the putter head body according to the present invention.

Referring to FIGS. 3 and 5 again, each weight 2 has a screw hole 23 at the back side adapted to receive a screw rod 3 or the link adapted for use to move the weights 2 in and out of the receiving holes 13.

Figure 7:
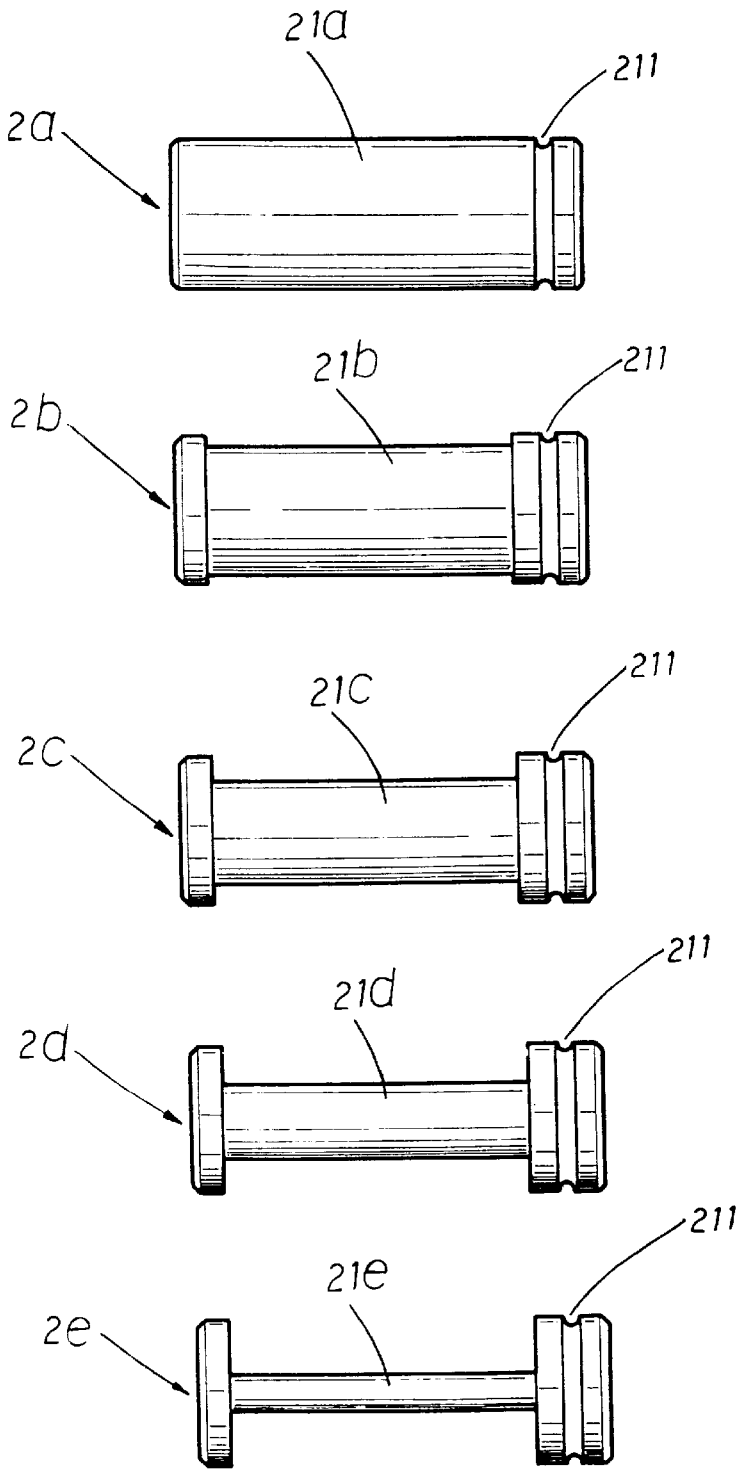
FIG. 7 shows various different alternate forms of the weight according to the present invention.
Figure 8:
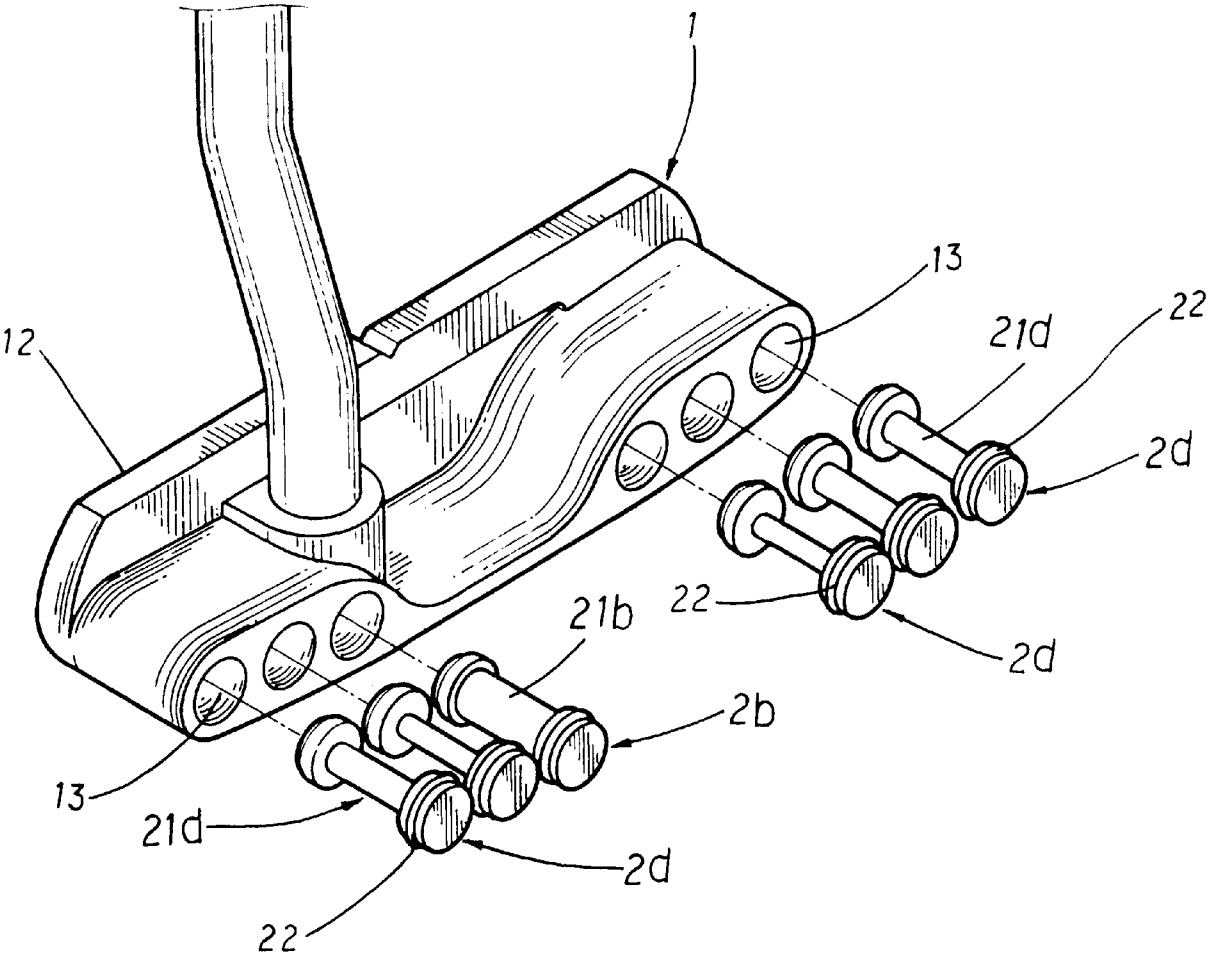
FIG. 8 is an exploded view showing the application of different weights of different shapes according to the present invention.

FIGS. 7 and 8 show various different alternate forms of the weight. The weights 2*a*~2*e* are made of same metal material, having a cylindrical middle part 21*a*~21*e*, and an annular groove 211 around the peripheral wall for the mounting of a rubber retaining ring 22. The cylindrical middle parts 21*a*~21*e* have different diameters. By means of selectively fastening the weights 2*a*~2*e* to the receiving holes 13 in the putter head body 1, the location of the center of gravity of the putter head body 1 is adjusted.

Figure 9:
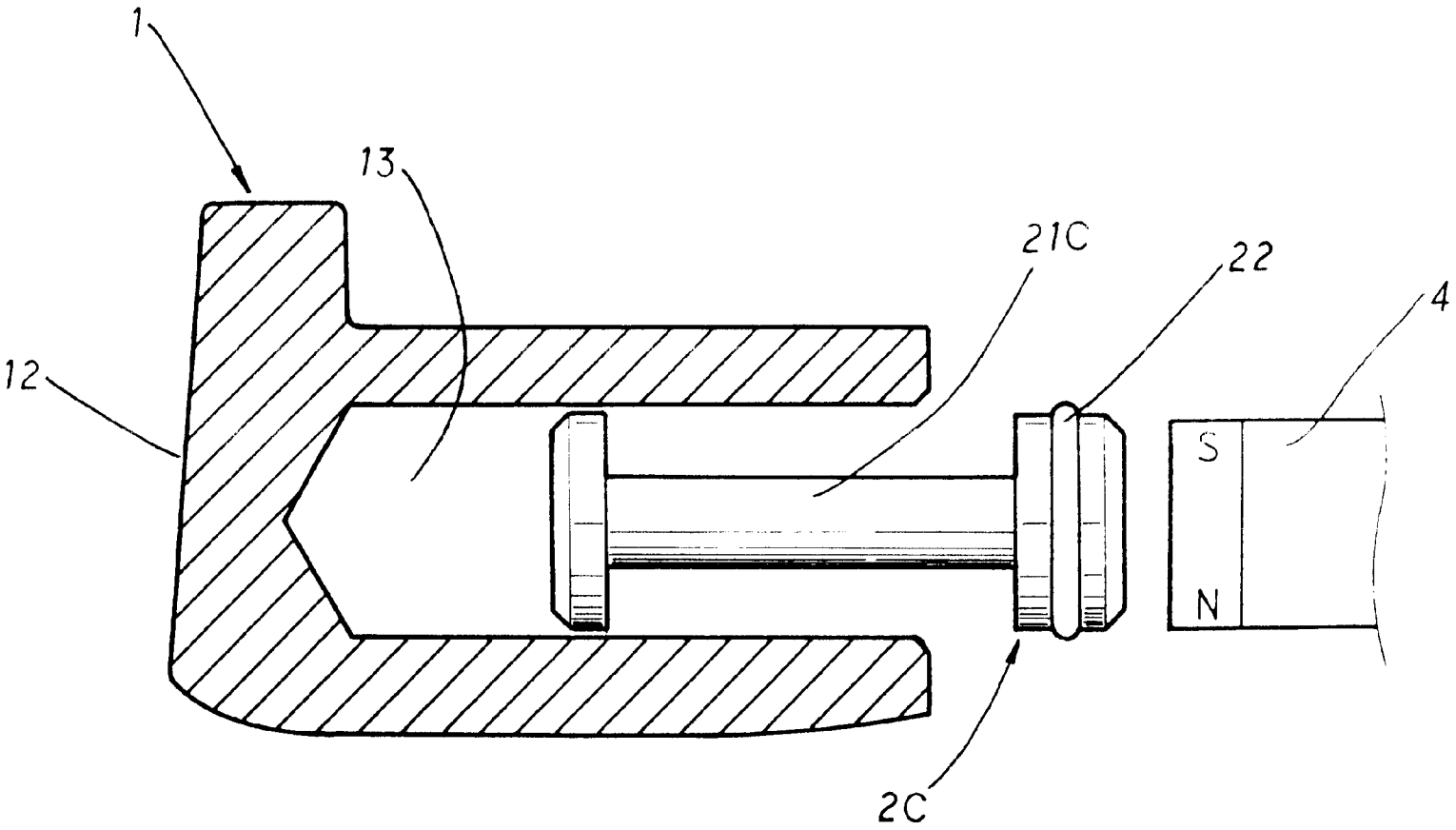
FIG. 9 illustrates the application of a magnetic device upon installation of a weight in one receiving hole of the putter head body.

Referring to FIG. 9, the weight 2*c* has a rear end made attractive to a magnetic device 4, therefore the weight 2*c* can be moved in and out of one receiving hole 13 of the putter head body 1 by a magnetic device 4.

It is to be understood that the drawings are designed for purposes of illustration only, and are not intended for use as a definition of the limits and scope of the invention disclosed.

What the invention claimed is:

1. A golf putter head and weight adjustable arrangement comprising:

a putter head body, said putter head body having a plurality of receiving holes respectively extended to a back side wall thereof in direction perpendicular to a face panel thereof; and a plurality of weights fitting the receiving holes of said putter head body and selectively fastened to the receiving holes of said putter head body to adjust the location of the center of gravity of said putter head body, said weights each having at least one annular locating groove around the periphery thereof and at least one rubber retaining ring respectively mounted on said at least one annular locating groove and adapted to secure the respective weight to the receiving holes of said putter head body.

2. The golf putter head and weight adjustable arrangement of claim 1 wherein said weights are made of materials of different specific gravity, having the same dimension.

3. The golf putter head and weight adjustable arrangement of claim 1 wherein said weights each have a rear tool hole adapted to receive a hand tool being used to carry said weights in and out of the receiving holes of said putter head body.

4. The golf putter head and weight adjustable arrangement of claim 1 wherein said weights each have a rear end made attractive to a magnetic device.

5. The golf putter head and weight adjustable arrangement of claim 1 wherein said weights each have a conical front end.

* * * * *